US008555934B2

(12) United States Patent
Allef et al.

(10) Patent No.: US 8,555,934 B2
(45) Date of Patent: Oct. 15, 2013

(54) METHOD FOR FILLING AND EVACUATING A DISPENSER UNIT AND FILLING INSERT FOR DISPENSER UNIT

(75) Inventors: Petra Allef, Krefeld (DE); Bernd Nauels, Kempen (DE); Markus Pielen, Schwalmtal (DE)

(73) Assignee: Evonik Degussa GmbH, Essen (DE)

( * ) Notice: Subject to any disclaimer, the term of this patent is extended or adjusted under 35 U.S.C. 154(b) by 475 days.

(21) Appl. No.: 12/863,868

(22) PCT Filed: Jan. 20, 2009

(86) PCT No.: PCT/EP2009/050606

§ 371 (c)(1),
(2), (4) Date: Jul. 21, 2010

(87) PCT Pub. No.: WO2009/095337

PCT Pub. Date: Aug. 6, 2009

(65) Prior Publication Data

US 2010/0294394 A1 Nov. 25, 2010

(30) Foreign Application Priority Data

Feb. 1, 2008 (DE) ..... 10 2008 002 765

(51) Int. Cl.
*B65B 31/00* (2006.01)

(52) U.S. Cl.
USPC ..... 141/7; 141/8; 141/18; 141/65; 222/152; 222/401; 222/481

(58) Field of Classification Search
USPC ..... 141/7, 8, 26, 29, 65, 20, 25, 85, 290, 141/31, 302; 222/152, 105, 401, 481
See application file for complete search history.

(56) References Cited

U.S. PATENT DOCUMENTS

| | | | | |
|---|---|---|---|---|
| 5,489,044 | A * | 2/1996 | Ophardt | 222/1 |
| 5,692,649 | A | 12/1997 | Schwab | |
| 6,666,355 | B2 * | 12/2003 | Padar | 222/152 |
| 7,389,893 | B2 * | 6/2008 | Kasting | 222/321.4 |
| 7,717,142 | B2 * | 5/2010 | Padar | 141/26 |
| 7,815,076 | B2 * | 10/2010 | Ophardt | 222/185.1 |
| 2003/0178098 | A1 * | 9/2003 | Brass et al. | 141/383 |
| 2008/0304978 | A1 | 12/2008 | Ophardt | |

* cited by examiner

FOREIGN PATENT DOCUMENTS

| | | | |
|---|---|---|---|
| DE | 10048898 | A1 | 4/2002 |
| EP | 0836824 | A | 4/1998 |

OTHER PUBLICATIONS

International Preliminary Report on Patentability (Chapter 1) Written Opinion for Application No. PCT/EP2009/050606; Sep. 7, 2010 (12 Pages).

*Primary Examiner* — Timothy L Maust
*Assistant Examiner* — Timothy P Kelly
(74) *Attorney, Agent, or Firm* — Stetina Brunda Garred & Brucker

(57) ABSTRACT

The invention relates to a method for filling and evacuating a dispenser unit for paste-like, foam-form or liquid media. In the known methods, a storage container is evacuated via a suction pump, which otherwise serves for the delivery of the medium, after filling. The risk exists hereby that medium is drawn in. In order to make the drawing-off process more effective and more reliable, a method and a filling insert for a dispenser unit are proposed according to the invention, wherein at least one air duct is provided parallel to the suction pump. The evacuation takes place by the application of a pressure difference between storage container and the environment, which is just so great that air can in fact be drawn through the air duct but no viscous medium can be drawn.

20 Claims, 4 Drawing Sheets

Abb. 5

Abb. 1

Abb. 2

Abb. 3

Abb. 4

Abb. 5

Abb. 6

METHOD FOR FILLING AND EVACUATING A DISPENSER UNIT AND FILLING INSERT FOR DISPENSER UNIT

CROSS-REFERENCE TO RELATED APPLICATIONS

The present application claims priority to PCT International Application No. PCT/EP2009050606 which was filed on Jan. 20, 2009 which claims priority to German Patent Application Serial No. 10 2008 002 765.0 filed on Feb. 2, 2008.

STATEMENT RE: FEDERALLY SPONSORED RESEARCH/DEVELOPMENT

Not Applicable

BACKGROUND

1. Technical Field of the Invention

The invention relates to a method for filling and evacuating a dispenser unit for paste-like, foam-form or liquid media. The generic method, without however being restricted hereto, concerns, in particular, media in the form of skin cleansing, skin protection and skin care agents, which are provided in a storage container which has a suction pump arranged in a pump mounting of the storage container. The storage container is sealed by means of the suction pump to mitigate air penetrating from the exterior, so that even in the case of a reserve which is running low, no air is present in the storage container and a mixing of delivered medium with residual air can be avoided. Thus, the bubble formation known from conventional toiletries upon removal of the final residue from the storage container, and hence an irregular portioning in the delivered portion can be prevented. The suction pump is able to be activated by an actuation movement, either of a mechanical lever or via a sensor and an electric actuator, with a portion of the medium then being delivered in liquid form or foamed by the pump assembly of the suction pump.

2. Description of Related Art

From EP 0836824 A, an evacuation method is known for the production of such a dispenser unit. From EP 0774074 A, in turn, a dispenser unit is known. Within the scope of filling the dispenser unit by the manufacturer, the storage container is firstly filled with the medium by the generally collar-like pump mounting which is provided with an internal or external thread. The suction pump is then inserted into the pump mounting and subsequently a suction device is connected with the storage container, via which a pressure difference is produced between the environment and the interior of the storage container, by means of which air masses situated in the storage container are drawn off.

The suction pump is embodied here as a one-way pump so that it can in fact deliver medium in the installed state, but a flowing back of air is not possible, to obtain the vacuum in the interior of the storage container. The composite of storage container and suction pump which is produced in this way is designated below as the filling insert and is inserted into a dispenser housing with a suitable actuating device, the suction pump then being functionally coupled with the actuating device.

After insertion of the filling insert into the dispenser housing, the storage container is gradually emptied during operation, until the entire filling insert, i.e. the composite of storage container and suction pump, is completely emptied and is then fully exchanged for refilling of the dispenser unit. The dispenser units are suitable for the delivery of all conceivable media, with the medium situated in the storage container generally being able to be liquid in the raw state, with any desired viscosity, up to paste-like media. Preferred areas of application are, for example, liquid soap, skin protection creams or other liquid cleansing or care products for the skin.

In the case of the known dispenser units or of the known evacuation method, the air is drawn off, after closing of the filling insert by assembling with the suction pump via the pump plunger through the suction pump. The disadvantage of this solution, however, consists in that a precise process management is necessary in order to prevent an unintentional drawing in of the liquid medium and hence an undesired partial emptying. Such an emptying within the production entails not only imprecise filling quantities, but also brings with it contaminations of the filling devices. Finally, for precise emptying, the process must be run through carefully and hence in a time-consuming manner, in order to ensure on the one hand that the air is completely drawn off, and on the other hand to prevent the storage container from being unintentionally partially emptied again by the drawing off of medium.

It is therefore a first object of the invention to provide a method for filling a dispenser unit, in which a desired quantity of medium can be filled reliably and quickly, without the addition of air, into the filling insert. A further object of the invention consists in the provision of a filling insert and a dispenser unit, which is able to be filled on the basis of the evacuation method.

BRIEF SUMMARY

The first object with regard to the method is solved according to the invention in that a filling insert is used with a pump mounting and a suction pump, wherein the filling insert has at least one air duct, connecting the interior of the storage container with the environment and which is able to be closed during filling. The filling insert is embodied so as to accommodate a first pressure level, in which air is drawn out from the storage container, and a second pressure level, in which the medium penetrates into the air duct, wherein the first pressure level and the second pressure level are distinguishable from each other by the flow counter-pressure. The drawing off is terminated and the air duct is closed on or before, in particular shortly before or after reaching the second pressure level.

The further object with regard to the filling insert is solved according to the invention in that the filling insert has at least one air duct, connecting the interior of the storage container with the environment and is able to be closed during filling, and is arranged outside the conveying path of the suction pump. The duct is embodied such that at a first pressure level, air can be drawn out from the storage container, and at a second pressure level, medium penetrates into the air duct, wherein the first pressure level and the second pressure level are distinguishable from each other by the flow counter-pressure, so that before, at, or shortly after reaching the second pressure level, this is detectable and the drawing off can be terminated and the air duct can be closed.

Through the development of the method according to the invention, the air still remaining after the filling of the storage container can now be automatically drawn off, wherein through the special design of the pump mounting, it is at least largely ensured that only air and no medium can escape, as a result of the applied pressure level operating the gas venting through the pump mounting. The invention also utilizes the fact that due to the viscosity of the medium and the duct geometry of the air duct, a much greater suction force would be necessary for the drawing off of medium, than for drawing off the air situated in the storage container. This is possible in particular in that the generic storage containers have a collapsible wall, so that the drop in pressure necessary for drawing off the air must substantially only act against the elastic restoring forces of the collapsible wall and, if applicable, against the fluid tension of the filled medium. As also in the generic method, the storage container is produced for this, for example from a foil material, and can have additional corrugations to form predetermined kinking points.

Additional air ducts are provided, via which the air can be drawn off during the evacuation of the storage container. The additional air ducts are embodied such that as a result of the viscosity of the medium a significant pressure rise occurs when all of the air is drawn off and instead of air, medium would now be drawn in. This effect is achieved according to the invention by the design of the air duct, wherein the pressure gradient can be achieved in the most varied of ways. This can take place in the simplest case in that the air duct is embodied to be correspondingly thin, so that viscous medium could only be drawn through the air duct with greater force.

Alternatively, labyrinth-like paths of the air duct could also be provided, or flow-impeding measures can be provided in the air duct, for example a filter or several filters. Usually, however, the filling insert will be embodied as a disposable article, so that the manufacturing costs for this are to be kept low. This is achieved through a simple geometry of the air duct or air ducts. Theoretically, air ducts arranged at a distance from the pump mounting could also be arranged in the wall of the storage container, wherein, however, the arrangement of the air ducts according to the invention in the region of the pump mounting or of the pump itself is particularly advantageous, because a filling and evacuation of the storage container through a shared opening is particularly economical.

In a preferred manufacturing method of the filling insert, the latter is firstly filled with the medium with the filling opening standing upright. The suction pump is then fastened to the pump mounting and then the filling insert, which is thus produced, still filled with air, is evacuated. This has the advantage that the suction pump does not have to be put in position under vacuum conditions. Subsequently, the drop in pressure can be applied via a suction spout.

For the functioning of the invention, it is essential that the air duct connects the interior of the storage container with the environment such that the suction spout for drawing off the air is able to be connected to the outlet of the air duct. In a preferred development, for example, the pump mounting is constructed so that the suction pump is provided with an internal thread and can be screwed into the pump mounting.

The air duct can then either be arranged between thread turns of the screw connection, can penetrate the pump mounting itself or else the edge material of the suction pump. A closing of the air duct can take place in this development for example by thermal welding, gluing or by valve means.

Another development of the filling insert has a pump mounting with an external thread. The suction pump is then placed onto this external thread in the manner of a bell, and is screwed on or glued or respectively welded. In this development, the air duct can either emerge out from the pump mounting laterally or it penetrates both the pump mounting and also, for example, the region of the suction pump wall projecting over the pump mounting. In the latter case, the filling insert can be produced in a particularly simple manner. The storage container with the pump mounting integrally connected herewith can be produced easily and simply by the so-called blow moulding process. The external thread can then be formed at the same time within this manufacturing process.

The air duct can likewise already be formed here, by the projecting thread turns namely being interrupted longitudinally to the direction of the subsequent air duct. At the same time, the thread turns of the internal thread of the suction pump are interrupted, so that with a corresponding rotation angle position of the two structural elements, the thread has the continuous air duct. The fact that the air duct can be closed by simple rotation of the thread, so that initially for evacuation of the filling insert, the suction pump is not screwed on up to abutment up to the pump mounting, is particularly favourable in this embodiment.

In this state, the interruptions of the thread projections in the pump mounting and in the suction pump are congruent with each other and thus leave the air duct open. The remaining thread regions, however, already seal off, just as the collar of the pump mounting. The evacuation can now take place, then the suction pump is turned a small amount further, so that the interruptions of the thread projections are no longer congruent with each other and the thread seals off completely. Additionally or alternatively, sealing can of course also take place here by thermal welding methods or adhesion methods, by the thread connection between pump mounting and suction pump for example being heated briefly under pressure.

In the embodiment described above of the air duct integrated into the thread, a region outside the air duct can be coated with an additional sealant or adhesive, which with the final tightening of the suction pump also expands into the region of the earlier air duct and later hardens and thus additionally brings about a seal.

In a further preferred embodiment of the method according to the invention, the air is drawn off via a suction device which has a measuring device which can detect whether air is still situated in the storage container or not. Such a measuring device can, for example, be a volume flow detector or a measuring device for the flow counterpressure. In the first case mentioned, evacuation is carried out until no more air is present, whereas in the second case, the evacuation is terminated on occurrence of the increased flow counterpressure. Since the air is present in the region of the pump mounting, evacuation is carried out reliably in this way in both cases.

Alternatively, evacuation can also be carried out via a simple time-controlled regulation, recognizing that time and pressure conditions remain approximately the same in mass production. Thus, it can be determined experimentally how long evacuation must usually be carried out. Even when a certain additional value is added to provide the necessary security, no medium is drawn in as long as the pressure level is set accordingly. Therefore, an underpressure is used for evacuation which is in fact suitable for the drawing off of air, but is currently not low enough to draw the more viscous medium through the air ducts. In order to shorten the time interval for evacuation, preferably several, in particular up to four, air ducts are used.

Finally, the device producing the underpressure or the supply line can also be provided with a pressure-limiting valve, which prevents the application of a "critical" pressure, i.e. a pressure close to or above the second pressure level. Here, irrespective of the time and the counterpressure, drawing off can take place simply over an appointed time span. In the same way, this can be achieved by a limitation of the suction power of the device.

As an alternative to the application of an underpressure at the outlet of the air duct, an excess pressure can also be exerted on the storage container. This also makes possible a particularly favourably priced production of the filling insert, because the latter can firstly be filled again with the pump mounting standing upwards, then the suction pump is also screwed on here or fastened on the storage container in another way. Then the volume of the storage container can be reduced via a clamping device, with the clamping device being able to apply in particular a clamping force which is controlled via the counterpressure.

This is able to be achieved particularly easily for example in that the pre-produced filling insert, after filling, is compressed by two clamping jaws, lying opposite each other, clamping the storage container between them and being under spring loading. The clamping force is then to be dimensioned such that it does in fact produce an excess pressure, which corresponds to the first pressure level, but is not able to compress the storage container such that the excess pressure reaches the second pressure level. In this way, without using a vacuum device, the air can be pressed out from the storage container. In this stage, i.e. before the releasing of the clamping force, the air duct can then be closed either again by turning the functional components relative to each other or by welding or gluing.

Alternatively to the embodiment described above, the external pressure can also be exerted onto the suction pump or onto the pump mounting, in order to thus compress the storage container in the filling direction. This preferably presents itself when the device can exert an elastic pressure onto the pre-mounted filling insert. In particular when the closing of the air ducts takes place by means of a further turning of the screw connection of the suction pump with the pump mounting, the compression pressure can thus be simply brought about with a tool and at the same time the closure movement can be realized.

The gripping tool, which applies the suction pump onto the pump mounting and then screws it, then remains in its rotary movement simply in the angle position in which the air ducts are open and then at the same time exerts the pressure for the production of the first pressure difference for a certain duration of time. If the evacuation has been completed after this period of time has elapsed, then the pump mounting can be turned further with the same gripping tool, so that through this additional turning movement, the air duct is closed. A detent connection between the pump mounting and the suction pump can prevent a back rotation additionally or alternatively to the measures described above, for example of the thermic welded joints or the adhesive connections.

More complex embodiments of the filling insert can also have air ducts which are able to be closed via one-way valves. Here, the valves are embodied such that after the evacuation, a flowing back of air is not possible. In addition, the valve can undertake the function of a pressure-selective flow limiter, wherein valve members are present which close the one-way valve when the second pressure level is reached. Alternatively, the valve members in the air duct can also only open so slightly that in the manner of a gap or labyrinth seal, the viscous medium can not pass the valve on application of the first pressure level.

A further preferred embodiment of the invention, uses a movably mounted suction pump. Here, the pump means of the suction pump are mounted displaceably within the cylinder-like pump mounting on a piston-like carrier, with the air ducts being arranged in the pump mounting or the wall of the suction pump such that by a longitudinal displacement of the piston-like carrier in the delivery direction of the suction pump, the air ducts are closed.

In this embodiment, the air can then be firstly drawn off by application of the first pressure level, a continuous reduction of the suction pressure up to reaching the second pressure level then brings about a releasing of the piston-like carrier with the displaceable pump means from a first mounting and the movement of the piston-like carrier into the position for use with, at the same time, closure of the air ducts. This can be realized for example in that in the cylindrical inner wall of the pump mounting, the suction pump is displaceably mounted with a collar which is under tension, and is arranged in the evacuation position inside a groove. When the pressure is now increased, the elastic ring springs out from this groove and the piston-like carrier can then be displaced with the pump means.

The air ducts here connect the region of the storage container with the inner side of the wall of the pump mounting, wherein they emerge from the pump mounting at a site lying in front of the evacuation position of the edge of the piston-like carrier but behind the usage position of the pump means. Alternatively, and at a particularly favourable cost, the air ducts can also be formed by simple grooves inside the cylinder wall of the pump mounting, which extend in the displacement direction and terminate before the site at which the piston-like carrier comes to a standstill with the pump means in the usage position. These grooves must of course be effected to be so deep that the elastic edge or other sealing means can not unintentionally obstruct the air duct.

The embodiment of the invention having the previously described displaceable pump means has the particular advantage that automatically by reaching the second pressure level, the displaceable pump means are drawn in and thereby the air ducts are closed. It is therefore sufficient, during the filling of the filling insert, to apply a corresponding pressure level, wherein here a pressure is even sufficient which corresponds to the second pressure level or even lies higher. Here, firstly, the air would be drawn off and only then would a displacement of the pump means take place by the flow pressure of the viscous medium, wherein in the case of a pressure which is too high, the danger of course exists that despite the geometry of the air ducts, medium is drawn out through the air ducts. For this reason, it will also be advisable in this embodiment to firstly apply a first pressure level, in order to be able to reliably convey exclusively air over a certain duration of time, and possibly in addition only thereafter, by increasing the pressure level, to activate the displacement of the pump means.

Also of course in the embodiment described above, instead of the application of an external underpressure, the displacement of the pump means can take place by application of an external pressure onto the storage container. A further optional feature can be a pump mounting which is embodied so that the filling insert is only able to be inserted into the dispenser housing in the case of displaced pump means. In the conventional dispensers, on insertion of the filling insert into the dispenser housing, a holding clip grips an edge of the pump means, wherein hereby the functional coupling takes place between the actuating device of the dispenser and the pump.

In displaceable pump means, it is now possible that the pump mounting is drawn so far down that only with pump means displaced in the usage position, from the point of view of the holding clip of the dispenser housing, the edge which is to be gripped becomes visible. As a result of the non-displaced piston-like carrier of the suction pump, the filling insert is not ready for use and with a corresponding embodiment is also not able to be inserted into the dispenser housing. For this, the region into which the holding clip is inserted can be embodied so that the holding clip only fits onto the pump plunger in the usage position, but in the previous degassing or transportation position, a region of the pump plunger adjoins the holding clip, which is not able to be connected therewith, because for example it has too large a diameter.

Displaceable pump means, in connection with a pump mounting which is drawn down in the manner of a collar, entail a further advantage. When the pump mounting is drawn down so far that the delivery tube of the pump, in a transportation position of the suction pump, is completely surrounded by the, for example hollow cylindrical, pump mounting, at the same time the pump means are protected by the edge of the pump mounting from damage. In this way, a saving can be made regarding a transportation covering, and the filling inserts can be transported standing upright on the pump mounting, so that if required they can be removed from the shipment box and inserted in the same orientation into the dispenser housing.

Of course, it must be avoided that the air ducts remain open during transportation, because through the liquid tensions and the restoring forces of the wall of the storage container, air could enter into the storage container again. In order to prevent this, before despatching the filling inserts, the manufacturer can close the air duct by conventional means, for instance by gluing or welding. Alternatively, in addition to the longitudinal displaceability, the pump can for example also be mounted rotatably in the pump mounting, so that the air ducts are able to be closed by a rotary movement after evacuation, in order to thereby achieve a transportation position with a closed duct.

Finally, the displacement can also be arranged in three stages, wherein in a first position, as described above, the air ducts are open and after overcoming a first displacement path of the piston-like carrier into a second position, the air ducts or the air duct is closed, without pump parts of the suction pump projecting out from the protecting region of the pump mounting. In a third position, after overcoming a further distance of the displacement path, the suction pump can then be in the usage position and can be coupled for example with the clip of a dispenser housing.

In addition, the longitudinal displaceability of the pump means can also only be possible after rotation of the pump means; for this, corresponding tongue-and-groove joints can be provided in the piston/cylinder connection between the pump mounting and the pump means. In the latter case, then of course evacuation can only be carried out with the first pressure level, because an automatic closure of the air ducts is then not possible.

Finally, the air ducts can also be completely separated from the displaceably mounted suction pump. In this case, the suction pump can be arranged for instance on the carrier which is displaceable in the piston-like pump mounting, whereas the air ducts penetrate the pump mounting parallel to the displacement path. After the evacuation, the air ducts can be closed here by gluing or welding; alternatively a two-part ring can be used as the pump mounting, wherein two concentric ring elements, lying one over the other, are penetrated by the continuous air duct in an angle position and after the evacuation can be turned relative to each other and then fixed, so that the two duct sections are then turned to each other and thereby the air duct is closed. A corresponding seal is of course necessary here and can take place for example by gluing of the ring segments, a shrink film applied from the exterior, or similar measures.

The mounting of the suction pump on the piston-like carrier and its displaceability within the cylinder-like pump mounting can also be used independently of the evacuation method described here. The claiming of an independent protection without the function of the air ducts therefore remains expressly reserved.

Further features and advantages of the invention will be apparent from the sub-claims and from the following description of a preferred example embodiment with the aid of the drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

Figure 1:
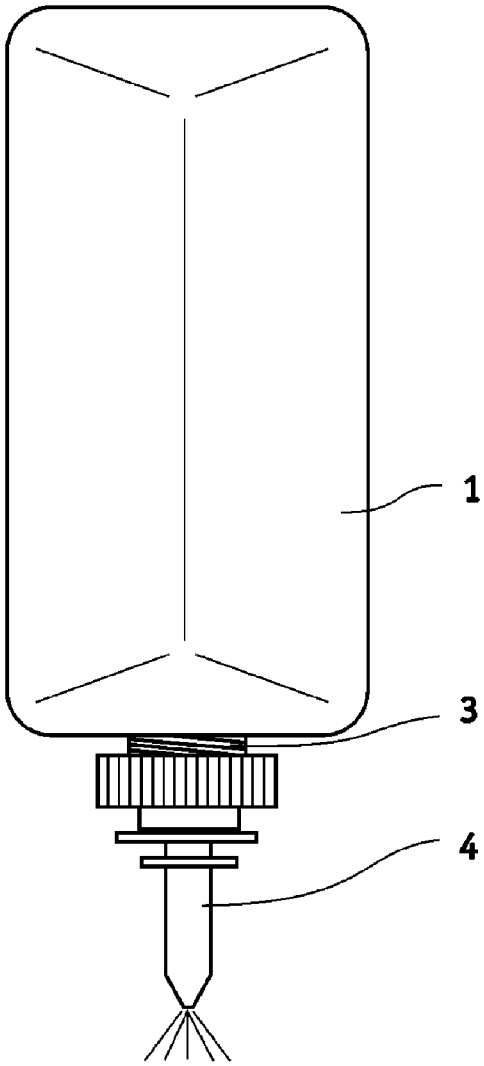
FIG. 1 illustrates a filling insert according to the invention.

In FIG. 1 a filling insert according to the invention is illustrated. The filling insert consists of a storage container 1, which has a pump mounting 4 in the lower region. Such a storage container 1 can be produced from a plastic tube by the known blow moulding process. Within this manufacturing process, at the same time, as generally known from the prior art, the pump mounting 4 can also be formed onto the lower part of the storage container 1.

Figure 2:
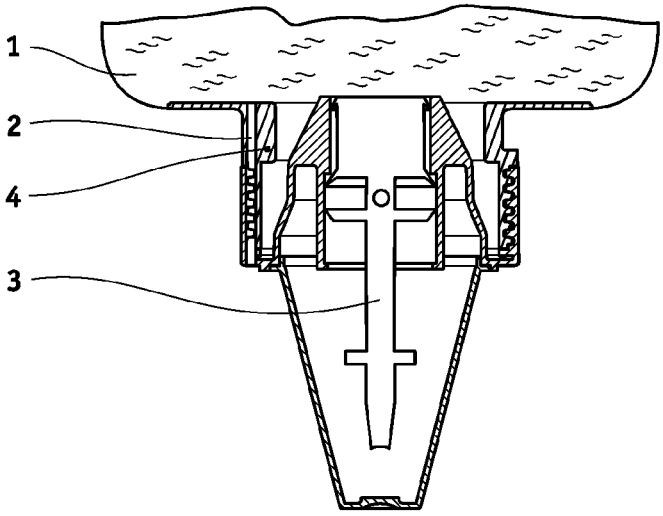
FIG. 2 illustrates a sectional view of a suction valve according to the invention.

In the exemplary embodiment which is shown, the pump mounting 4 has a thickened wall region of the storage container 1, which is provided with an external thread. The pump mounting 4 and the suction pump 3 which is screwed thereon are illustrated in FIG. 2 in an enlarged detail view in section.

The suction pump 3, illustrated here only as an exemplary embodiment, can have any known form and does not differ substantially from the known pumps. It is generally constructed as a one-way pump and can be activated via an actuating device after insertion of the filling insert into a dispenser housing. The actuating device can be mechanical, wherein then a holding clip of the dispenser housing grasps a part of the pump plunger, in order to then move it to and fro on actuation of a so-called "push button", in order to thus actuate the suction pump.

Alternatively, the suction pump 3 can also be actuatable in a contactless manner; for this, the dispenser housing then has a corresponding sensor system and an electric drive for the holding clip. Electric pumps can also of course be used. All the features of the dispenser housing which described herein are basically only to be regarded as an example for the application of the invention and are not intended to restrict it in its range of application.

An essential feature of the invention relates to the fact that in addition to the actual conveying path of the suction pump 3, at least one air duct 2 is provided, through which the air can be evacuated from the storage container 1 after the filling of the storage container 1. The air duct 2 is embodied here so that the counterpressure levels differ significantly, depending on whether air or medium would be conveyed through the duct. With a first pressure level, air can be easily and simply drawn off from the storage container 1. With a second pressure level, on the other hand, the viscous medium would have to be drawn through the air duct 2, wherein the second pressure level is much higher than the first, because the medium is distinctly more viscous than water in most applications. However, even in the case of a viscosity which corresponds to that of water, a corresponding difference would be present in the pressure level.

The invention now makes use of these two pressure levels, in order to stop the evacuation either automatically on reaching the second pressure level, i.e. on entry of medium into the front region of the air duct, or in order to apply a pressure level which does not reach the second pressure level, so that even with a longer or even permanent exposition of the first pressure level, a drawing off of medium is impossible.

In the illustrated suction pump 3, the air duct 2 penetrates both the thread of the pump mounting 4 and also the thread of the suction pump 3. For this, with both components, the projecting thread turns are provided with a groove, wherein with congruence of the two grooves, i.e. with a particular rotation angle of the components relative to each other, the air duct 2 remains free.

The air duct 2 can, as illustrated here, run parallel to the screw-in direction of the suction pump 3 into the pump mounting 4. However, it is also possible that the air duct 2 has a different geometry, for example is wound around the cylindrical plane of the screw connection, opposed to the winding of the thread. It is also possible that the air duct 2 is guided out from the pump mounting 4 or respectively the suction pump 3 after a certain distance. Depending on the embodiment, this lateral guiding out of the air duct 2 can facilitate closing after evacuation by gluing or welding.

The air duct 2 which is illustrated here can be easily closed by turning the suction pump 3 relative to the pump mounting 4, wherein then the grooves are no longer congruent with each other in the projecting thread regions, so that the air duct 2 is closed. To achieve an air-tightness, the thread can be constructed so that it can only be screwed on under a certain tension. As the filling insert is embodied as a disposable article, the thread also only has to be screwed a single time, so that the concern here is not whether the suction pump 3 can be released again later from the pump mounting 4. With the use of a corresponding elastic plastic, the thread can then be screwed on under tension, so that with the final turning of the screw connection into the final usage position, the air duct 2 is then closed in a sufficiently reliable manner.

Alternatively, in addition to the screwing of the suction pump 3 in the pump mounting 4, the thread can also be coated with a sealant or an adhesive, so that after hardening, a sealing takes place, wherein the medium can also be dimensioned so that after turning the suction pump 3 into the final usage position, the sealant or adhesive expands into the region of the earlier air ducts 2. A corresponding geometry of the thread turns can intensify this effect.

Figure 3:
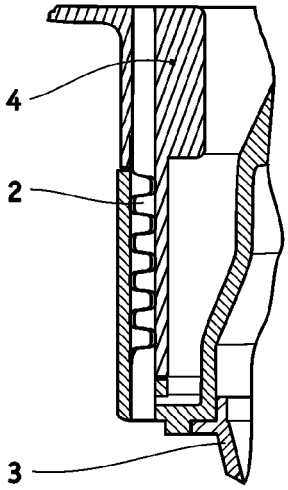
FIG. 3 illustrates the region of the air duct of the embodiment according to FIG. 2 in an enlarged illustration.

In FIG. 3 the embodiment according to FIG. 2 is reproduced in the region of the air duct 2 in an enlarged illustration. The interruption of the thread turns by the grooves is illustrated here parallel to the delivery direction of the pump. In the rear region of the air duct 2, the projecting sections of the thread, intersected by the grooves, can be seen, via which the pump mounting 4 is connected with the suction pump 3.

Figure 4:
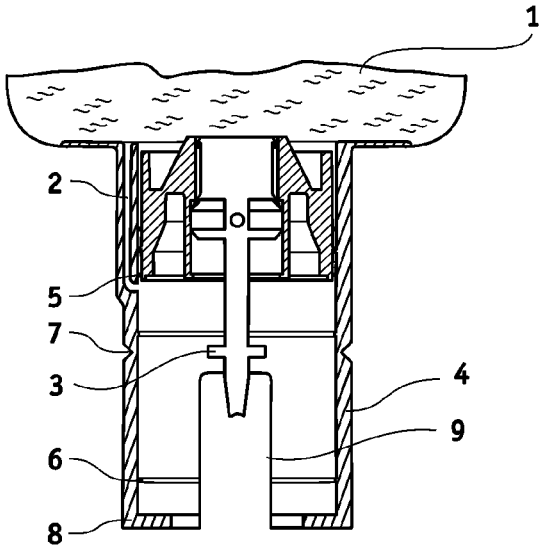
FIG. 4 illustrates a further embodiment of a filling insert according to the invention, with a pump, displaceable in the delivery position of the suction pump, in venting position.

In FIG. 4 a further development of the invention is illustrated. Here, the suction pump 3 is arranged on a pump carrier which is movably mounted in the pump mounting 4. The air duct 2 is introduced in the upper region of the pump mounting 4 into the wall of the pump mounting 4, which is constructed for this with double walls in the upper left-hand region. Alternatively to the air duct 2 arranged inside the wall, it can also be provided in the form of a groove countersunk into the cylinder wall of the pump mounting 4, which serves as a "bypass", in order to be able to draw out the air past the piston-like pump carrier.

For a simplified illustration of the invention, only one air duct 2 is illustrated respectively in all the example embodiments. In practice, the filling inserts can of course have several air ducts 2, which in particular has the advantage that the evacuation times are reduced, because the air situated in the storage container 1 can be drawn off via a plurality of openings, with a sufficient counterpressure nevertheless being built up, when the medium reaches the entry of the air ducts 2.

In the exemplary embodiment illustrated herein and in the position of the suction pump 3 illustrated in FIG. 4, the air duct 2 opens out beneath the piston-like pump carrier into the piston-like movement space for the suction pump 3. An underpressure can now be applied at this piston-like region of the pump mounting 4. This firstly brings it about that the air is drawn out from the storage container 1, until the flow counterpressure rises significantly owing to the fact that the flow front of the medium reaches the entry of the air ducts 2. With a suitable geometry of the air duct 2, in particular with regard to the diameter, the piston-like pump carrier is now previously driven and hence moved before the flow front of the medium by the underpressure.

For this, firstly a first detent connection 6 is to be overcome, which is designed so that the force which is necessary for this is, on the one hand, so low that the piston-like pump carrier can be moved by the flow front without substantial quantities of the medium passing through the air duct 2. On the other hand, the detent connection 6 must ensure through a correspondingly high detent force that the underpressure which is necessary for drawing off the air in fact does not bring about any movement of the piston-like pump carrier.

Figure 5:
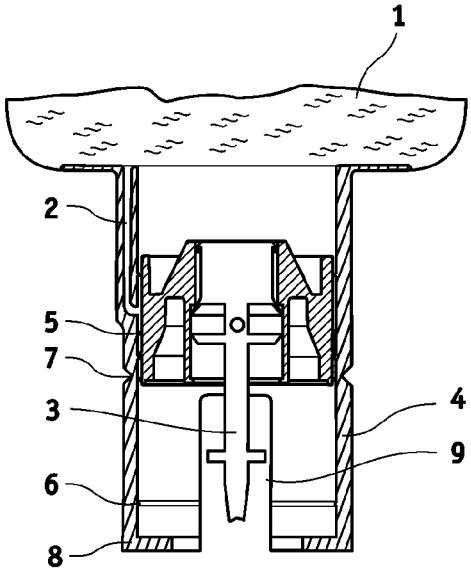
FIG. 5 illustrates the embodiment according to FIG. 4, wherein the pump carrier is moved into an intermediate position, closing the air duct.

In FIG. 5, the filling insert of FIG. 4 is illustrated, wherein the piston-like pump carrier is situated in a position in which the air duct 2 is already closed, so that air can not flow back again in the form of leakage flows laterally between the piston and the cylinder wall into the storage container 1, the piston is provided in the lower region with at least one seal 5 which seals the gap between the cylinder wall of the pump mounting 4 and the piston of the pump carrier.

As can be seen in FIG. 5, the air duct 2 now opens in this gap, however on the other side of the seal 5, so that the air duct 2 was automatically closed by the displacement of the piston-like pump carrier. This is a great advantage of this embodiment of the invention, because it is merely necessary to apply a pressure in the region of, or above, the first pressure level, which automatically leads to the air duct 2 being closed by the displacement of the piston, so that even in the case of high pressures no medium can be drawn in. This makes possible a rapid and efficient drawing off method and hence manufacturing method.

Alternatively to the underpressure described here, which is applied to the piston-like annular space of the pump mounting, an excess pressure can of course also be applied to the storage container 1 from the exterior. In this embodiment of the invention, it is particularly advantageous here that the air does not necessarily already have to be driven out from the filling insert by the manufacturer. Instead of this, it is also possible to exert an external pressure onto the storage container 1 only shortly before filling the dispenser unit with the filling insert, in order to thus on the one hand drive out the air from the storage container 1 and on the other hand to move the suction pump 3 into the operating position. This external pressure can be applied manually, but an advantageous embodiment of the dispenser unit can, however, also have an automatic arrangement, which on closing of the dispenser housing automatically exerts the necessary pressure onto the storage container 1.

For this, a pressure element can be provided for example in the dispenser housing, which exerts a certain pressure on the storage container 1, either when the filling insert is inserted into the dispenser housing or when the dispenser housing is then closed. To realize the first-mentioned solution, the dispenser housing can, for example, have a mounting, narrowing in the insertion direction, for the storage container 1, wherein the walls of the mounting can be spring-loaded, so that on insertion of the filling insert they are pressed apart against the load of the springs and subsequently, until a first emptying of the storage container 1 has taken place, they transfer the elastic force onto the medium.

To transfer the second-mentioned solution, likewise a spring-loaded pressure element can be provided in the dispenser housing or also in a cover which is connected in a foldable manner with the dispenser housing, said pressure element being pressed by the closing movement of the cover against the storage container 1. Here, also, the elastic force is firstly transferred to the storage container 1 and, after the driving out of the air, is then transferred via the medium to the piston-like pump carrier.

In the position of the piston-like pump carrier illustrated in FIG. 5, the latter is in turn engaged in a detent connection 5. In this position, the air duct 2 is closed, so that the storage container 1 is evacuated and a flowing back of air is prevented. In the embodiment of the invention which is illustrated here, the cylinder-like pump mounting 4 is further extended distinctly beyond the position of the piston-like pump carrier. This extension serves as a transportation security for the suction pump 3, which in the illustrated position is still situated completely inside the cylinder wall. This transportation security allows the filling inserts to be transported standing upright on the pump mounting 4, so that either the hitherto usual security cap or the transportation standing upside down can be dispensed with.

Figure 6:
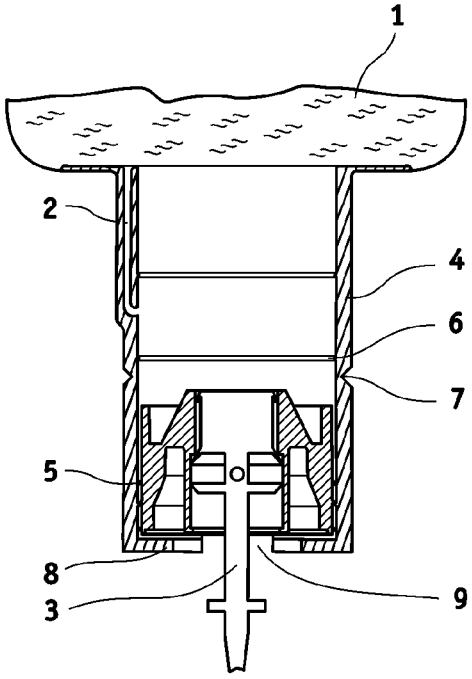
FIG. 6 illustrates the embodiment from FIGS. 4 and 5, wherein the suction pump is situated in the usage position.

Insofar as no importance is attached to transportation security, the position illustrated in FIG. 5 can also be the usage position of the suction pump 3. In this case, of course the cylinder wall will be constructed very much shorter, so that the mounting device of the dispenser housing can hold the pump plunger of the suction pump 3 laterally. If, on the other hand, a transportation security is desired, then either, as illustrated in FIG. 6, the path to be covered by the piston-like pump carrier can be extended up to the end of the cylinder wall, or the cylinder wall has, for example, a predetermined breaking point 7, via which, after removal of the filling insert from the outer packaging, the lower part of the cylinder wall can be removed. The ring-shaped transportation security, lengthening the cylinder wall, can of course also be connected via other connections with the cylinder wall of the pump mounting 4, wherein then an additional component would again be necessary.

The predetermined breaking point 7 illustrated in FIGS. 4 and 5 is to be regarded herein as an alternative to the longer displacement path, which is illustrated herein only to explain the function in a shared embodiment of the invention. In practice, either the displacement path will be so long as shown in FIG. 6 or alternatively a predetermined breaking point 7 will be provided.

Alternatively, to form the transportation security, instead of the cylindrical ring which is illustrated in FIG. 5 beneath the predetermined breaking point 7, other forms of spacers can also adjoin the cylinder wall, wherein the mounting device can either engage between these spacers or wherein predetermined breaking points 7 are also provided here, so that these spacers are also removable.

In FIG. 6, the piston-like pump carrier is pushed into the usage position. As this last displacement path is only covered after removal of the filling insert from the outer packaging, the pressure necessary for the movement must either be applied in situ, manually as described above or via the dispenser housing. Alternatively, it is possible that this last displacement path is not covered in a pressure-driven manner, but rather that the operating personnel pulls the piston-like pump carrier by hand into the usage position. Finally, it is possible that the mounting aid of the dispenser housing, known from the prior art, for example in the form of a so-called "catcher clip", via a positive guide after engagement of the plate-like holding edge of the pump plunger of the suction pump 3, pulls the latter downwards together with the piston-like pump carrier.

Both for manual movement in the usage position and also for application of the mounting aid, a mounting window 9 can be provided in the cylindrical wall of the pump mounting 4, through which either the mounting aid of the dispenser housing or a fitter by hand or with a tool can hold the piston-like pump carrier or a part of the suction pump 3 and can pull it downwards. The mounting window 9 is constructed here, as can best be seen from FIG. 4, as an elongated hole which is open on one side, which extends from the lower edge of the cylindrical wall of the pump mounting 4 in the direction of the storage container 1. The form and geometry of the mounting window 9 are, however, freely selectable according to the necessary displacement path and the embodiment of the suction pump 3. The suction pump 3 or the piston-like pump carrier can also be provided with an additional lever which projects out through the mounting window 9, so that an actuation of the lever moves the suction pump 3 into the usage position.

The cylindrical wall of the pump mounting 4 has stops in the lower region as path delimiters 8. These path delimiters 8 prevent a further withdrawal of the piston-like pump carrier, so that further pressure onto the storage container 1, for instance unintentionally on mounting, cannot lead to the suction pump 3 falling out from the pump mounting 4.

In the usage position, the actuating force of the dispenser acts on the suction pump 3 and hence on the piston-like pump carrier. The pump and the pump carrier work together to ensure that the pump is not pushed upwards again. Along these lines, the pump carrier must be secured in the usage position. A detent connection 6 can therefore also be provided in the lower position, fixing the piston-like pump carrier. As the pump must no longer be pushed back after reaching the usage position, this lower detent position can be embodied so that it is now only detachable in a way involving it being destroyed.

An unintentional pushing up of the piston-like pump carrier by the actuating force of the dispenser can be further avoided, additionally or alternatively to the detent connection, in that the mobility of the piston-like pump carrier in the usage position is blocked by an additional security against displacement. Such a security against displacement can, for example, be formed by a security pin inserted laterally into a bore in the cylinder wall. In addition, it is possible that on insertion of the filling insert or on closing of the dispenser housing, a security arrangement engages in a form-fitting manner into the piston-like pump carrier or its displacement path. For this, the piston-like pump carrier can, for example, have in the lower region, similar to the plunger of the suction pump 3, a laterally projecting plate-like edge or a pin guided out from the cylinder, which can be engaged or engaged behind by a corresponding part of the dispenser housing.

Finally, in a further embodiment of the invention, the mounting aid of the dispenser can also engage directly through the mounting window 9. In this embodiment, the position of the pump carrier shown in FIG. 5 is, for example, the usage position, the mounting window 9, which is then an access window, is drawn upwards here so far that the plate of the pump plunger can be reached and engaged by the mechanism of the dispenser through this window. In this case, the path delimiters 8 (not illustrated here) are then arranged beneath the piston, as shown in FIG. 5, and the lower part of the cylinder serves exclusively for transportation security. This does not have to be removed via the predetermined breaking point 7, because the functioning is in fact ensured via the mounting window 9.

Basically, it is possible to provide the piston-like pump carrier, which is displaceable via the internal pressure of the container, and hence the displacement of the suction pump 3, also without the particular type of evacuation of the storage container 1, described here, via the air duct 2, as transportation security.

The invention claimed is:

1. A method for filling and evacuating of a dispenser unit for the delivery of a paste-like, foam-form, or liquid medium, the method comprising the steps of:

providing a filling insert including:

a storage container configured to store the medium;

a suction pump connectable to the storage container and defining a suction pump conveying path;

at least one air duct fluidly connecting the interior of the storage container with the ambient environment during filling and closable after evacuation, the at least one air duct being arranged outside the conveying path of the suction pump, said air duct being embodied such that at a first pressure level, air is evacuated from the storage container, and at a second pressure level, the medium penetrates into the air duct, the first pressure level and the second pressure level being distinguishable from each other via the flow counter-pressure, and on or shortly after reaching the second pressure level, the evacuation air is terminated and the air duct is closed; and a one-way valve arranged in the air duct, which only operates upon reaching of the second pressure level;

filling the storage container with the medium;

fastening the suction pump to a pump mounting of the storage container;

producing a pressure difference between the ambient environment and the interior of the storage container, via which air situated in the storage container is evacuated through the air duct; and closing the air duct via the one way valve on or shortly after the second pressure level is reached.

2. The method recited in claim 1, wherein the one-way valve is a pressure-selective flow limiter configured to close when the second pressure is reached.

3. The method recited in claim 1, wherein the one-way valve is configured to restrict air from flowing into the storage container after evacuation.

4. The method described in claim 1 further comprising the steps of:

using a measuring device to determine whether air is present in the storage container; and maintaining the pressure difference until the second pressure level is determined via the measuring device.

5. The method described in claim 4 wherein on reaching the second pressure level, the device producing the pressure difference is stopped.

6. The method described in claim 5 further comprising the step of producing an externally applied underpressure via an underpressure source which causes the pressure difference, the underpressure source having a pressure limiting valve which limits the applied underpressure to between the first and the second pressure levels.

7. The method described in claim 6 further comprising the step of preventing the pressure difference from exceeding the second pressure level by utilizing an underpressure source having a power limitation which prevents the pressure difference from exceeding the second pressure level.

8. The method described in claim 7 further comprising the step of evacuating air through the air duct when the pressure difference is produced.

9. The method described in claim 8 further comprising the step of applying an external pressure via a pressure device onto the storage container for production of an increased internal pressure.

10. The method described in claim 9 wherein the external pressure is exerted onto one of the pump mounting and the suction pump.

11. The method described in claim 10 wherein the external pressure is exerted via a biased pressure device which is applied with a maximum pressure force against the storage container such that the internal pressure of the storage container lies above the first pressure level and below the second pressure level.

12. The method described in claim 1 further comprising the step of closing the air duct via the one-way valve on or shortly after reaching the second pressure level, the closing activity of which is switched automatically via the internal pressure of the storage container being lower than the ambient pressure.

13. The method described in claim 11 further comprising the step of closing the air duct in a fluid-tight manner by a blocking device.

14. The method described in claim 13 further comprising the steps of mounting the suction pump in the pump mounting so as to be displaceable from a filling position into a usage position, wherein by the displacing of the suction pump into the usage position, the outlet of the air duct is closed and the suction pump is fixed in the usage position;

displacing the suction pump via the pressure difference force, the suction pump being mounted such that a movement of the suction pump only takes place on reaching the second pressure level;

grasping a mounting unit embracing the pump mounting and the suction pump mounted therein on the side of the delivery side of the suction pump via a suction spout, such that the suction spout draws in the mounting unit with a suction bell, wherein the air duct opens into the underpressure space of the suction bell and the mounting unit is placed onto the previously filled storage container via the suction spout and is then fastened there, wherein air which is still present after fastening of the mounting unit is evacuated from the storage container via the suction spout and the air duct is then closed; and cooling the medium to produce a higher flow counterpressure.

15. The method described in claim 13 wherein:

the suction pump is mounted in the pump mounting so as to be displaceable from a filling position into a usage position, wherein by the displacing of the suction pump into the usage position, the outlet of the air duct is closed and the suction pump is fixed in the usage position;

the displacement of the suction pump is caused by the pressure difference and the suction pump moves upon reaching the second pressure level;

the air duct is formed by a straight or curved duct, similar to a bore, which penetrates the suction pump, bridging the pump mounting.

16. A filling insert for a dispenser unit for a paste-like, foam-form or liquid medium, the dispenser unit including a storage container for the medium and a suction pump, arranged on the storage container in a pump mounting and sealing the storage container against air penetrating from the exterior, the suction pump being configured to deliver the medium in response to an actuating action, the filling insert comprising:

at least one air duct connecting the interior of the storage container with the ambient environment during filling, and configured to be closed after evacuation, the at least one air duct being arranged outside a conveying path of the suction pump, wherein at a first pressure level, air can be evacuated from the storage container and at a second pressure level, medium penetrates into the air duct, wherein the first pressure level and the second pressure level are distinguishable from each other by the flow counterpressure, so that on or shortly after reaching the second pressure level this is detectable, so that the evacuation is terminated and the air duct can be closed; and a one-way valve in fluid communication with the air duct, which only operates upon reaching of the second pressure level, thereby closing the air duct.

17. The filling insert recited in claim 16, wherein the one-way valve is a pressure-selective flow limiter having valve members which close the one way valve when the second pressure level is reached.

18. The filling insert as described in claim 16 wherein the air duct is formed by a straight or curved duct, similar to a bore, which penetrates the wall of the suction pump and/or the pump mounting.

19. The filling insert as described in claim 16 wherein the pump mounting has a plurality of air ducts.

20. A filling insert for a dispenser unit for a paste-like, foam-form or liquid medium, the dispenser unit including a storage container for the medium and a suction pump, arranged on the storage container in a pump mounting and sealing the storage container against air penetrating from the exterior, the suction pump being configured to deliver the medium in response to an actuating action, the filling insert comprising:

at least one air duct connecting the interior of the storage container with the ambient environment during filling, and configured to be closed after evacuation, the at least one air duct being arranged outside a conveying path of the suction pump, wherein at a first pressure level, air can be evacuated from the storage container and at a second pressure level, medium penetrates into the air duct, wherein the first pressure level and the second pressure level are distinguishable from each other by the flow counterpressure, so that on or shortly after reaching the second pressure level this is detectable, so that the evacuation is terminated and the air duct can be closed;

wherein the air duct is formed by a straight or curved duct, penetrating the wall of the suction pump;

wherein the air duct being coupled to the pump mounting, the pump mounting having a duct section, and with a defined screw-on angle of the suction pump onto the pump mounting the two duct sections to an open duct are congruent with each other and by further turning of the suction pump the two duct sections are able to be moved away from each other to close the air duct; and wherein the air duct at least in one dimension has a width of less than 2.

* * * * *